United States Patent [19]

Long

[11] Patent Number: 4,844,287

[45] Date of Patent: Jul. 4, 1989

[54] LEAK CONTAINMENT SYSTEM FOR UNDERGROUND STORAGE TANKS

[76] Inventor: Delmar D. Long, 141 Timber La., Rock Hill, S.C. 29730

[21] Appl. No.: 120,624

[22] Filed: Nov. 13, 1987

[51] Int. Cl.[4] ..... G01M 3/00

[52] U.S. Cl. ..... 220/429; 220/1 B; 220/5 R; 220/5 A; 220/455; 220/469; 405/54; 405/53; 73/49.2

[58] Field of Search ..... 220/455, 460, 461, 1 B, 220/429; 73/49.2 T

[56] References Cited

U.S. PATENT DOCUMENTS

| | | | |
|---|---|---|---|
| 3,453,164 | 7/1969 | Gursky et al. . | |
| 3,489,311 | 1/1970 | Folkerts | 73/49.2 |
| 3,700,512 | 10/1972 | Pearson et al. . | |
| 4,152,183 | 5/1979 | Honacker et al. . | |
| 4,523,454 | 6/1985 | Sharp | 73/49.2 |
| 4,579,617 | 4/1986 | Oberg et al. . | |
| 4,607,522 | 8/1986 | Sharp | 73/49.2 |
| 4,653,312 | 3/1987 | Sharp | 73/49.2 |
| 4,739,659 | 4/1988 | Sharp | 73/49.2 |

*Primary Examiner*—Stephen Marcus
*Assistant Examiner*—Gilbert W. Reece
*Attorney, Agent, or Firm*—Timothy R. Kroboth

[57] ABSTRACT

A double-walled leak containment system for an underground storage tank is provided. The underground storage tank is surrounded, in order, by an inner polymeric containment layer, a liquid transmissive textile, and an outer polymeric containment layer. The outer polymeric containment layer is advantageously formed by spray coating the textile.

4 Claims, 3 Drawing Sheets

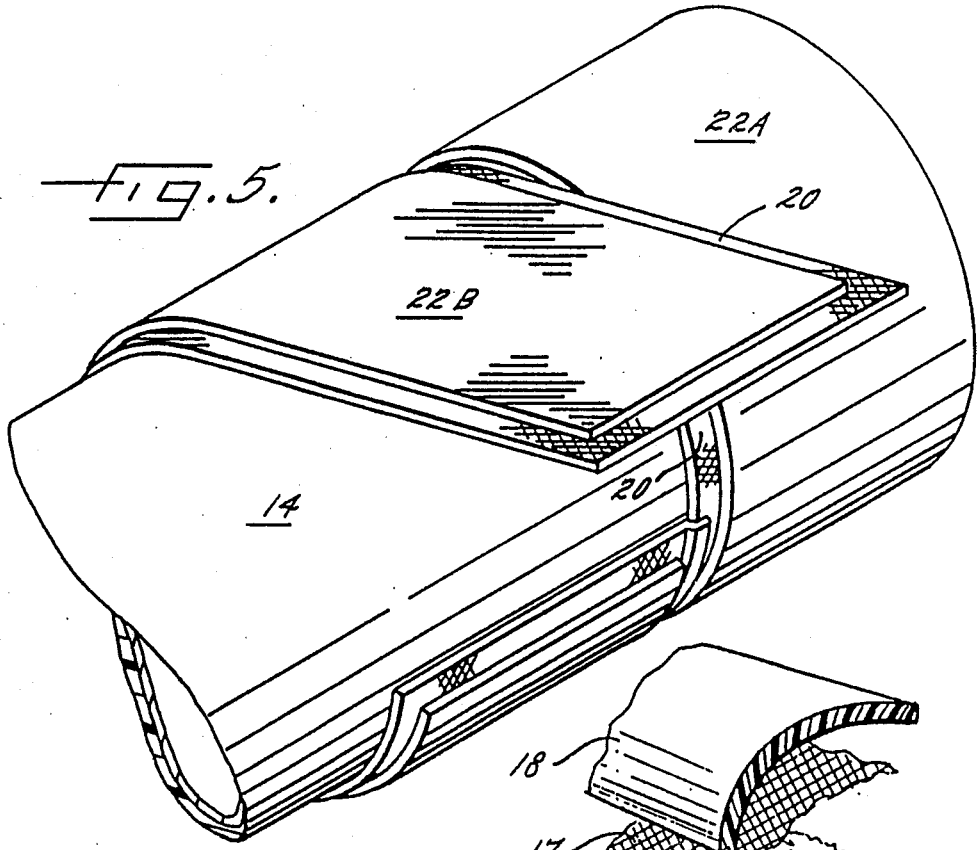
Fig. 5.
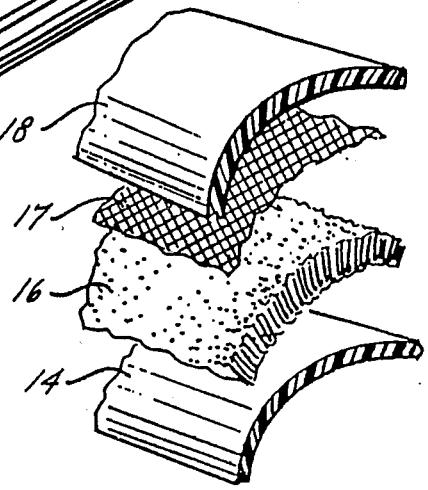
Fig. 7.
Fig. 6.
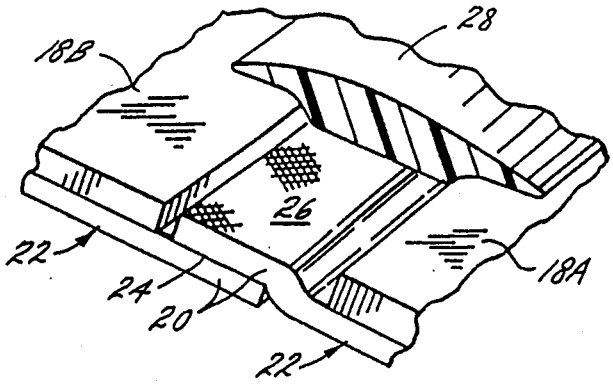

LEAK CONTAINMENT SYSTEM FOR UNDERGROUND STORAGE TANKS

BACKGROUND OF THE INVENTION

The present invention relates to a leak containment system for an underground storage tank, and more particularly, to a double-walled leak containment system, to an improved process for providing the same, and to a coating layer/textile composite useful in providing the same.

Several containment systems for underground storage tanks are available in the art. One such system involves enclosing a primary steel underground tank with a secondary steel containment jacket. The containment jacket assures that any leak from the tank will be captured in the space between the tank and the jacket. By continuously monitoring the space between the tank and the jacket, a warning of tank leakage is provided. Another system is to coat the tank with an epoxy or urethane paint, add zinc anodes to the tank, and/or put a pit liner around the tank structure.

One commercially available containment system involves wrapping the tank with a high-density polyethylene (HDPE) sheet which exhibits goods resistance to hydrocarbons and other chemicals, such that the tank is completely surrounded. The abutting ends of the HDPE sheet are heat welded together. Another available containment system involves attaching a geotextile to the bottom of an underground storage tank for its full length with double-faced tape; then wrapping a standoff polyethylene mesh around the tank body and tying the mesh in place; and thereafter wrapping a high density polyethylene sheet around the tank.

Also known, as illustrated by U.S. Pat. No. 3,453,164 to Gursky et al, is the use of polyurethane coating compositions in preparing fuel-resistant, hydrolysis-resistant containment layers for fuel storage tanks.

SUMMARY OF THE INVENTION

An object of the present invention is to provide an improved containment system for an underground storage tank.

A further object is to provide a containment system that is economic, but yet is readily installed and has superior leak containment and puncture resistance.

A still further object is to provide a containment system having improved tensile, impact and abrasion strength.

Additional objects, advantages and novel features of the present invention are set forth in the description that follows, and in part will become apparent to those skilled in the art upon examination of the following description or may be learned by practice of the invention. The objects and advantages of the invention may be realized and attained by means of instrumentalities and combinations particularly pointed out in the appended claims.

To achieve the foregoing objects and in accordance with the purpose of the present invention, as embodied and broadly described herein, there is provided a novel process for forming a double-walled, leak containment system for an underground storage tank. The process includes the step of coating a liquid transmissive textile with an elastomer to form a polymeric containment layer that partially impregnates the textile. As a result, a high strength composite is formed at the interface of the textile and the polymeric containment layer.

Thereafter, the pre-coated textile is assembled to the outside surface of a storage tank so that the polymeric containment layer forms an outer polymeric containment layer. The process further includes the step of providing an inner polymeric containment layer between the pre-coated textile and the storage tank. As a result of the process, the storage tank is surrounded by a double-walled, leak containment system in which an unimpregnated portion of the textile retains its leakage adsorbing and transporting characteristics.

Also provided by the present invention is a unique leak containment system. The leak containment system includes a storage tank surrounded by a liquid transmissive textile coated with, and partially impregnated by, an elastomer. The elastomer forms an outer polymeric containment layer. The outer layer partially impregnates the textile to form a high strength composite at the interface of the textile and the outer containment layer.

The leak containment system further includes an inner polymeric containment layer disposed between an unimpregnated portion of the textile and the storage tank. The unimpregnated textile portion retains leakage adsorbing and transporting characteristics.

In addition, the present invention provides a leak containment system that includes a storage tank surrounded by a liquid transmissive textile further encased by a stretchable, conformable structure. The stretchable, conformable structure is coated with, and partially impregnated by, an elastomer. The elastomer forms an outer polymeric containment layer. The outer layer partially impregnates the stretchable, conformable structure to form a composite at the interface of the stretchable structure and outer containment layer. An inner polymeric containment layer is disposed between the liquid transmissive textile and the storage tank.

BRIEF DESCRIPTION OF THE DRAWING

Reference is now made to the accompanying drawing, which forms a part of the specification of the present invention.

FIG. 5 illustrates assembly of pre-coated sheets 22 with an underground storage tank;

FIG. 6 illustrates a technique for joining the sheets of FIG. 5 to form an outer containment layer;

FIG. 7 illustrates a containment system in accordance with another embodiment of the present invention.

DETAILED DESCRIPTION OF THE INVENTION

Figure 1:
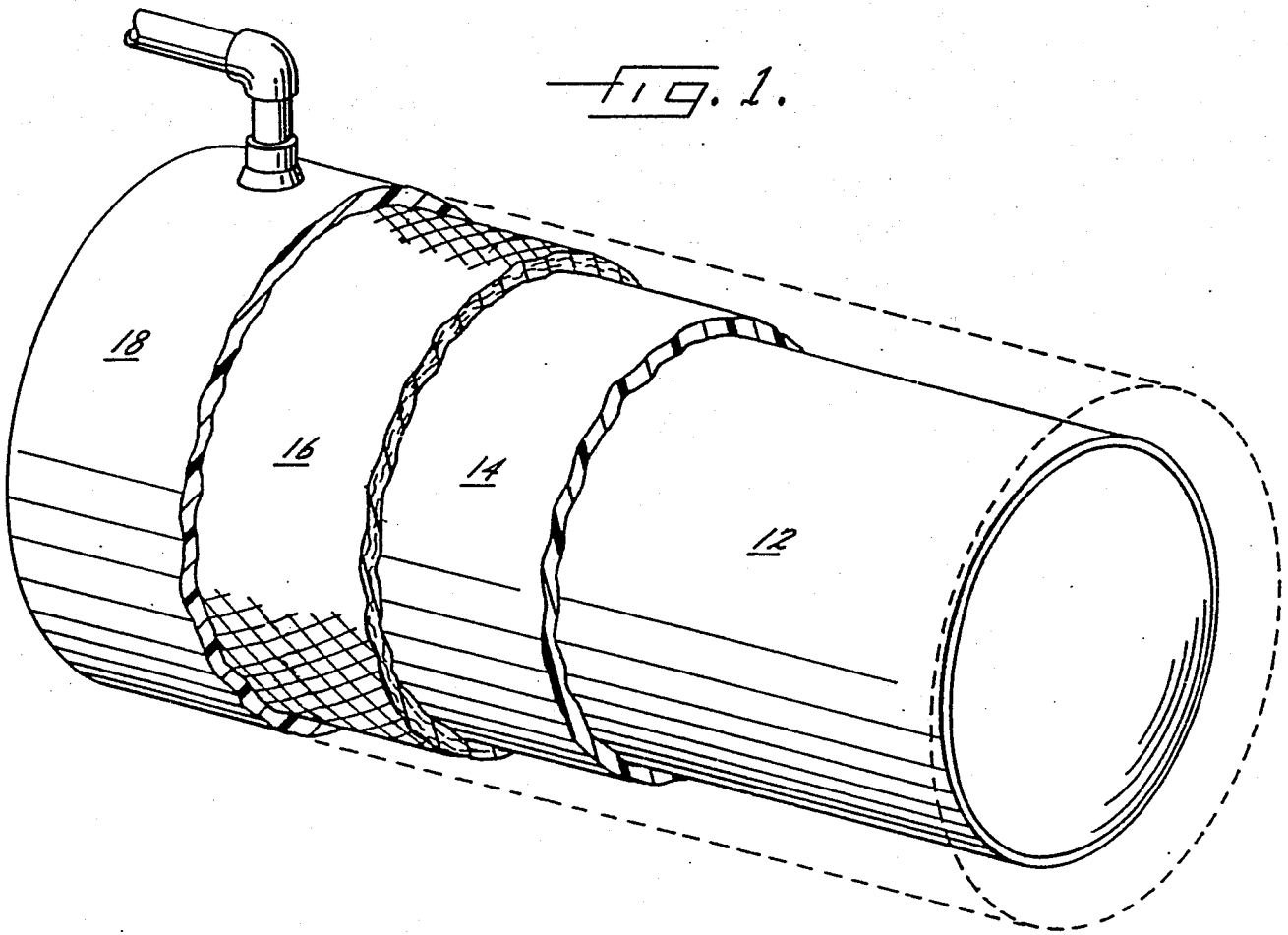
FIG. 1 illustrates a double-walled leak containment system for an underground storage tank, in accordance with the present invention, with layers of the containment system shown partially removed.

The present invention provides a novel leak containment system as shown in FIG. 1. An underground storage tank 12 is formed from metallic materials although fiberglass tanks are also common. Before installation of the containment system, the outside tank surface may be prepared by sandblasting and priming.

In accordance with the present invention, an inner polymeric layer 14 is provided between a liquid transmissive textile 16 and the outside surface of tank 12. Inner layer 14 essentially completely surrounds the tank.

This inner layer serves several purposes. Layer 14 provides resistance to the creation of holidays and forms the first containment layer. Holidays are concentrations of galvanic forces caused by a scratch or defect in a coating. A scratch or defect will cause a tank to fail (rust) much faster. In addition, inner layer 14 contributes corrosion resistance to the underground storage tank by sealing the outside of the tank from ground water and moisture.

If desired, polymeric containment layer 14 may be directly applied to the outside surface of tank 12. Such may be achieved by, for instance, spraying the tank with a polymer, which will advantageously be an elastomeric polymer.

Useful elastomers are well known in the art, with as described in U.S. Pat. No. 3,453,164 to Gursky et al, a polyurethane coating composition being highly preferred. Beginning at col. 4, line 35, and continuing through column 7, line 15, a sprayable polyurethane coating composition is described by Gursky et al. That disclosure is hereby incorporated by reference into this description of my invention, with the further statement that as in Gursky et al, a high solids coating composition, say about 70 to 90% or higher, even 100% if feasible, is preferred for use in my invention. Generally speaking, a relatively higher solids, sprayable coating composition will advantageously produce a relatively thicker spray coat per pass; hence, if possible, I prefer to use a 100% solids coating composition. Other pertinent disclosure is found in the Examples and at col. 9 of Gursky et al, and is also hereby incorporated by reference into this description.

Figure 2:
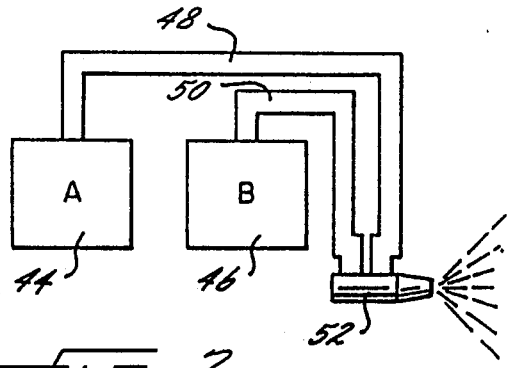
FIG. 2 illustrates a preferred spray coating technique.

FIG. 2 illustrates a preferred method for spraying a two part (A and B) polyurethane coating composition. Parts (A) and (B) are fed from their respective reservoirs 44 and 46 through feed lines 48 and 50 to a spray nozzle 52 where the components are mixed.

In forming inner containment layer 14, parts (A) and (B) are mixed and sprayed to a thickness of at least 0.5 mil. In a preferred embodiment, the thickness of the containment layer is about 0.5 to 50 mils. By using a spray technique for application of layer 14 to the storage tank, a seamless inner layer 14 can be formed.

Liquid transmissive textile 16 is disposed so that it also essentially completely surrounds the storage tank. The textile adsorbs any leakage from the underground storage tank 12. Additionally, the textile transports the leakage to a leak detector system. Leak detector systems are conventional in the art.

Useful materials for textile 16 include commercially available geotextiles which are woven, knit or non-woven fabrics which can readily conduct fluids and do not collapse under the weight of the filled underground storage tank 12. Depending upon the nature of the textile, it may serve as an additional barrier between the fluid contained within the storage tank and help cushion the tank in case of impact. A preferred geotextile is a needle punched fabric weighing 20 oz. per square yard available from Wellman Fibers of Charlotte, N.C. Similar materials are available from Phillips Petroleum Company and Amoco. Typically, the geotextile has a thickness of about 1.0 to 2.0 cm.

Another particularly useful material which can be used alone or in combination with a needle punched fabric, is a stretchable single piece fabric, which may be woven, non-woven or knit. Such fabrics can be obtained in a tubular form which can be slit and stretched over the storage tank alone or the storage tank enwrapped with a needle punched fabric. One of the particular advantages of using the stretched fabric alone or in combination with the needle punched fabric is that the stretched fabric substantially reduces the amount of elastomer required to form an outer polymeric layer 18. Needle punched fabric has a very high affinity for the elastomer and, as such, it has been found that about 0.120 inch of elastomer is required to form a liquid impervious, impact-resistant, outer layer 18. When the needle punch is overlayed with the stretched fabric, elastomer requirement for the outer layer can be reduced to about 0.35 inch.

Figure 3:
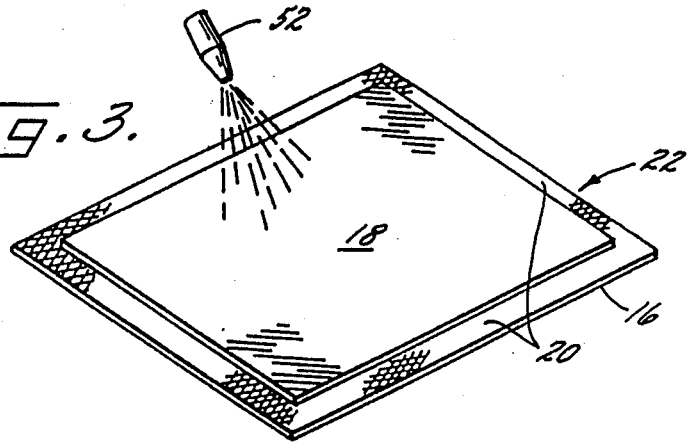
FIG. 3 illustrates the use of the spray-coating technique of FIG. 2, for forming a pre-coated textile sheet 22.

In accordance with the present invention, prior to assembly of textile 16 with storage tank 12, outer polymeric layer 18 is applied to textile 16. Advantageously, as shown in FIG. 3, application is effected using the preferred spray caating technique of FIG. 2. Beneficially, as in the case of inner layer 14, a polyurethane coating composition is used.

In the case of outer layer 18, a very high solids (about 85 to 100% solids, 100% solids preferably), spray coating composition should be used to provide control of the fabric depth impregnated by the outer layer. It will be understood that the depth obtained using a particular % solids, spray coating composition, will depend upon factors including the fiber, fiber diameter and fiber finish. Furthermore, it will be understood that, other factors being constant, a decrease in the % solids (the % solvent inversely increasing) will result in increased migration into fiber bundles.

With the exception of borders 20, textile sheet 16 is uniformly coated to form a polymer-coated textile sheet 22. In forming outer layer 18, the elastomer is sprayed to a thickness of at least 5 mils. Several passes may be required to build up this thickness. Typically, the thickness of this layer is about 5 to 500 mils, while in a preferred embodiment, the thickness is about 100 to 250 mils, very preferably about 20 to 60 mils.

Figure 4:
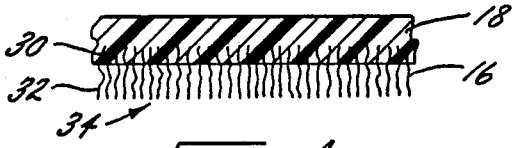
FIG. 4 is a cross-sectional view through precoated sheet 22 of FIG. 3, showing partial impregnation of one type of liquid transmissive textile.

This pre-coating step is particularly advantageous because in applying the elastomer to the surface of the liquid conducting textile in the form of a liquid composition instead of applying a premanufactured sheet, the elastomer can be allowed to partially impregnate the textile and thereby form a reinforced composite at the elastomer/textile interface. FIG. 4 shows a textile sheet 16 of needle punched fabric, coated with an elastomer to form outer layer 18. At the elastomer/textile interface, the needle punched fabric is impregnated by the elastomer, thereby resulting in the formation of a high strength composite 30. Formation of the composite enhances the tensile, impact, and abrasion strength of outer layer 18. Textile sheet 16, however, is only partially impregnated (e.g., about 10 to 20% of the sheet depth, up to even about 90% depending upon transmissivity requirements) such that an unimpregnated portion 32 of the sheet, which includes unimpregnated face 34, retains its liquid transmissivity characteristics.

Figure 8:
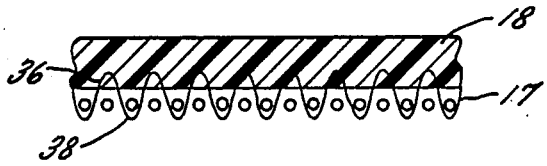
FIG. 8 is a cross-sectional view through fabric member 17 and outer layer 18 of FIG. 7, depicting partial impregnation of fabric member 17.

FIG. 8 illustrates a stretchable, conformable fabric member 17, which is impregnated on one face only with an elastomer to form outer layer 18. Fabric member 17 is only partially impregnated, typically in the range of about 40–70% of the depth. It will be understood that the foregoing considerations given for spray coating textile 16 with a polyurethane coating composition, apply to the coating/impregnation of fabric member 17.

As depicted in FIG. 8, a high strength composite 36 is again formed at the elastomer/fabric member interface. In this embodiment, the elastomer fills the interstitial spaces between the fabric yarn on one surface. The yarn on uncoated surface 38 of the fabric member are not encapsulated by the elastomer and, as such, are capable of transmitting fluid within the containment system.

As can be understood from the foregoing, the impregnation/coating step produces a coated textile that has enhanced strength but yet retains the adsorptivity and liquid transmissivity characteristics of the textile. In accordance with the invention, the pre-coated textile is assembled with storage tank 12 to form a double-walled containment system that essentially completely surrounds the tank. When assembled, layer 18 serves as an outer layer of the double-walled containment system. Outer containment layer 18 prevents fluids leaking from the tank and passing through inner layer 14, from contaminating the environment by containing them in the space between layers 14 and 18. Additionally, containment layer 18 contributes puncture resistance and corrosion resistance to the containment system.

If desired, a polymeric film may be applied to the inside surface of tank 12. Advantageously, the film is applied by spraying as shown in FIG. 2. Again, a polyurethane coating composition may be used to advantage in providing this coating. In applying this coating, the elastomer is sprayed to a thickness of at least about 0.5 mil, generally about 0.5 to 50 mils.

FIG. 5 illustrates an undergronnd storage tank 12 after spraying an inner polymeric coating layer 14 thereon. Pre-coated, textile sheets 22A,22B are shown being assembled on the coated storage tank such that sheets 22 overlap at the borders 20 thereof to surround the tank. It is to be understood that the number of sheets 22 required, depends on the dimensions of the tank and of the sheets. If desired, the partially impregnated textile may be manufactured as a continuous web and as such may be laid up on the storage tank.

FIG. 6 illustrates a preferred technique for joining pre-coated sheets 22. Sheet borders 20 are overlapped and heated together to form a seam 24. A gap or channel 26 resulting between adjacent elastomer coatings 18A,18B, is sprayed with a polymer, preferably an elastomer, to form a layer 28 that completely fills the gap and coats the edges of elastomer coatings 18A,18B. Layer 28 completely seals the precoated, overlapped sheets. A useful elastomer for this purpose is a polyurethane coating composition, as described earlier. Preferably, the elastomer is the same as that used to pre-coat sheets 22. In this manner, an outer containment layer is formed which essentially completely surrounds the storage tank so as to prevent fluids leaking from the storage tank, from contaminating the environment.

FIG. 7 illustrates a leak containment system in which a combination of a needle punched fabric and a stretch fabric is used. Like parts are numbered as in FIG. 1. A stretchable fabric member 17 is stretched over needle punched textile 16. The stretched member is coated with an outer layer 18 to form an interfacial composite which enhances impact strength, tensile strength and abrasion resistance. The thickness of the outer layer can be less than when needle punched textile 16 is coated directly with the outer layer.

In an exemplary process in accordance with the present invention, the outside surface of a steel underground storage tank is sandblasted and primed. Thereafter, the primed, exterior surface is spray coated with a 100% solids, two part, conventional polyurethane coating composition to form an inner containment layer of thickness ranging from 0.5 to 50 mils. A 100% solids coating system is advantageous because a greater thickness per pass is achieved than would be achieved with a less concentrated coating system. The spray-coated, inner containment layer is seamless.

Using the same polyurethane coating composition, the interior surface of the tank is spray coated to a thickness of 0.5 to 50 mils.

Again using the same polyurethane coating composition, a needle punched fabric weighing 20 oz. per square yard and having a thickness of 1.5 cm, is spray coated to a depth of 15% to provide a coating layer of thickness of 100 to 250 mils. Thereafter, the pre-coated textile is assembled to the tank, borders of adjacent textile sheets are overlapped and heated together to form seams, and gaps between the outer coating layer are filled by spray-coating using the same polyurethane coating composition. As a result, a double-walled, leak containment system is produced, which essentially completely surrounds the storage tank with an inner containment layer and an outer containment layer, and which includes between the containment layers an unimpregnated portion of the textile, which retains its leakage adsorbing and transporting properties.

Having described the invention in detail and by reference to preferred embodiments thereof, it will be apparent that modifications and variations are possible without departing from the scope of the invention defined in the appended claims.

I claim:

1. A leak containment system of improved tensile, impact and abrasion strength, said system comprising a storage tank surrounded by a liquid transmissive geotextile which is a fabric, further encased by a stretchable, conformable fabric, said stretchable, conformable fabric being coated with, and partially impregnated by in the range of about 40 to 70% of its depth, an elastomer which is a polyurethane useful for preparing a fuel-resistant, hydrolysis-resistant containment layer, said elastomer forming an outer polymeric containment layer, said outer layer partially impregnating said stretchable, conformable fabric to form a composite at the interface of said stretchable, conformable fabric and said outer containment layer; and an inner polymeric containment layer disposed between said liquid transmissive geotextile and said storage tank, said inner polymeric containment layer being in direct contact with said geotextile; wherein an unimpregnated portion of said stretchable, conformable fabric retains its fluid transmissive character.

2. The leak containment system of claim 1, wherein said inner polymeric containment layer is formed from an elastomeric polymer.

3. The leak containment system of claim 1, wherein said geotextile is provided by a plurality of partially overlapping sheets.

4. The leak containment system of claim 1, wherein said polyurethane is made from a polyether.

* * * * *